US005127604A

United States Patent [19]

Klaus, Jr. et al.

[11] Patent Number: 5,127,604

[45] Date of Patent: Jul. 7, 1992

[54] OPTICAL SYSTEM

[75] Inventors: Benjamin Klaus, Jr., Lexington; Gordon C. MacKenzie, N. Billerica; Richard A. Beckerleg, Boxford, all of Mass.

[73] Assignee: Raytheon Company, Lexington, Mass.

[21] Appl. No.: 751,486

[22] Filed: Aug. 29, 1991

Related U.S. Application Data

[63] Continuation of Ser. No. 395,692, Aug. 18, 1989, Pat. No. 5,072,890.

[51] Int. Cl.[5] ..... G01J 1/20

[52] U.S. Cl. ..... 244/3.16; 250/203.1; 250/342

[58] Field of Search ..... 244/3.16; 250/203.1, 250/342

[56] References Cited

U.S. PATENT DOCUMENTS 3,872,308 3/1975 Hopson et al. .
4,227,077 10/1980 Hopson et al. .
4,329,579 5/1982 Jansen et al. .
4,339,959 7/1982 Klaus, Jr. et al. .
4,973,013 11/1990 Klaus, Jr. .

*Primary Examiner*—Mark Hellner
*Attorney, Agent, or Firm*—Donald F. Mofford; Richard M. Sharkansky

[57] ABSTRACT

An optical system focuses a portion of electromagnetic energy into a spot on a focal plane and rotates the focused spot about an optic axis. A plurality of detectors is disposed in a detector plane. The array of detectors is arranged in a plurality of sets of such detectors. Each one of such sets of detectors is disposed along a different region extending radially from a central region of the array. When the detector and focal planes are skewed, a processor processes signals produced by a selected one of the plurality of sets of detectors. The selected one of the sets is the set disposed in one of the radially extending regions disposed along, or adjacent to, a line formed by the intersection of the skewed detector and focal planes.

11 Claims, 7 Drawing Sheets

TIME
REFERENCE COIL 66a INDUCED VOLTAGE ON LINE 66'a

CAGE COIL COMPENSATOR 80 OUTPUT VOLTAGE ON LINE 91

CAGE COIL COMPENSATOR 80 OUTPUT VOLTAGE ON LINE 91

CAGE COIL COMPENSATOR 80 OUTPUT VOLTAGE ON LINE 91

OPTICAL SYSTEM

This application is a continuation of Ser. No. 395,692 filed Aug. 18, 1989, now U.S. Pat. No. 5,072,890.

BACKGROUND OF THE INVENTION

This invention relates generally to optical systems and more particularly to optical systems which are adapted for use in infrared missile seekers.

As is known in the art, optical systems have a wide variety of applications including use in infrared missile seekers. One type of such missile seeker includes a gimballed, scanning and focusing system, such as a catadioptric arrangement having a primary and secondary mirror, for focusing infrared energy from an external source, such as a target, into a small spot on a focal plane within the seeker. The small spot is disposed in the focal plane at a point where the optic axis of the scanning and focusing system intersects the focal plane. The secondary mirror is tilted from the scanning and focusing system's axis of rotation. As the primary and secondary mirrors rotate as a unit about the axis of rotation, the small spot, and hence the optic axis, traces, or scans, in a circle on the focal plane. The position of the center of the circle traced in the focal plane is related to the boresight error (i.e., the angular deviation of the line of sight, or boresight axis, to the target from the axis of rotation). Fixedly disposed within the focal plane is a reticle which is also gimballed within the missile's body. As the tilted secondary mirror rotates about the axis of rotation, the intensity of the infrared energy passing through the reticle is both amplitude and frequency modulated in accordance with the boresight error. Such modulated infrared energy is directed onto a large, single photodetector, fixedly mounted to the missile body, by means of a refractive collecting optical arrangement. The response of the photodetector to the modulated infrared energy impinging thereon produces an indication of the boresight error. An example of processing signals produced by a reticle to obtain angular deviation is described in U.S. Pat. No. 4,339,959 issued Jul. 20, 1982, inventors Benjamin Klaus, Jr. and Gordon MacKenzie and assigned to the same assignee as the present invention.

As described, the scanning and focusing system is gimballed within the missile. Thus, for example, as described in U.S. Pat. No. 3,872,308, issued Mar. 18, 1975, inventors James E. Hopson and Gordon G. MacKenzie, assigned to the same assignee as the present invention, a gimbal system is coupled between the body of the missile and the scanning and focusing system to enable two degrees of freedom (i.e., pitch and yaw movement) of the scanning and focusing system within the missile. As described in U.S. Pat. No. 3,872,308, the detector is fixedly mounted to the missile. Thus, when using a reticle and a single detector, as the focusing system is gimballed in pitch and yaw, energy will be focused to arrive in focus at the reticle, and then collected at the large, single detector. The boresight error will be determined by processing the aforementioned reticle produced amplitude and frequency modulation on the energy collected by the detector.

However, recticle systems having a large, single detector may be limited in their ability to find and track targets. Further, a detector produces a noise voltage proportional to its diameter. Systems having multiple, small area detectors, such as an array of detectors, have better resolution of objects and increased sensitivity (i.e., signal-to-clutter and signal-to-noise (S/N)) ratios because of their small diameter. If the array of detectors is disposed in a detector plane fixed to the missile body, however, when the scanning and focusing system is gimballed in pitch and yaw the focal plane of the scanning and focusing system will be skewed with respect to the body fixed detector plane. Therefore, because the focal plane will be different from the detector plane an image in focus in the focal plane will not be in focus in the detector plane. In order for the image to be in focus to all the detectors in the array thereof, the plane of the detector plane would also be required to gimbal in pitch and yaw with respect to the missile body so that the focal plane and the detector plane remain in a common plane, regardless of the pitch and yaw orientation of the gimballed focusing system. However, as is further known, it is necessary to cool the detectors to cryogenic temperatures. Such cooling is typically accomplished by mounting the detectors to a Dewar flask and cryostat assembly. Thus, in a missile application having only a relatively small space for the scanning and focusing system, the array of detectors, the cryostat assembly, and the Dewar flask, it may not be possible to gimbal both the scanning and focusing system and an array of cryogenically cooled detectors in order to maintain the entire array of detectors in focus in systems requiring large gimbal angles of the scanning and focusing system.

SUMMARY OF THE INVENTION

With this background of the invention in mind it is therefore an object of this invention to provide an improved optical system having a focusing system adapted to gimbal with respect to a plurality of detectors.

Another object of this invention is to provide an improved missile seeker having an array of relatively small detectors fixed to the body of the missile and a focusing and scanning system gimballed with respect to the body of the missile.

These and other objects are obtained generally by providing an optical system wherein a focusing system focuses a portion of electromagnetic energy onto a focal plane. A plurality of detectors is disposed in a detector plane. When the focal plane and the detector plane are skewed, a processor processes signals produced by detectors aligned along, or adjacent to, the line formed by the intersection of the skewed detector and focal planes.

In accordance with a preferred embodiment of the invention, the optical system comprises: means for focusing a portion of electromagnetic energy from an object onto a focal plane including means for rotating the focusing system about an axis of rotation including means for scanning the focused portion in a circle in the focal plane, the angle between the line of sight to the object and the axis of rotation being related to the deviation of the center of the circle from the point where the axis of rotation passes through the focal plane; an array of detectors disposed in a detector plane, such array of detectors being arranged in a plurality of sets of such detectors, each one of such sets being disposed along a different region extending radially from a central region of the array, such central region being coincident with the point the axis of rotation intersects the focal plane; means for skewing the detector and focal planes; and, means, coupled to the skewing means, for processing signals produced by a selected one of the plurality of sets of detectors, such selected one of the sets being disposed in one of the radially extending regions disposed along a line formed by the intersection of the skewed detector and focal planes to provide a signal representative of the deviation of the center of the circle from the axis of rotation.

In a specific preferred embodiment of the invention the optical system is used as a missile seeker comprising: (a) means for focusing a portion of infrared energy from a target onto a spot in the focal plane and for rotating such spot in a circle on the focal plane, such spot being disposed on an optic axis of the focusing system, such focusing system including: (i) a catadioptric arrangement comprising a spherical primary mirror and an attached, flat, secondary mirror symetrically disposed about an axis of rotation, such secondary mirror being tilted by a predetermined angle with respect to an axis of rotation; and, (ii) means for rotating the catadioptric arrangement about the axis of rotation, with the optic axis tracing a circle as it intersects the focal plane, the center of the circle having a deviation from the axis of rotation related to the angular deviation of the target from the axis of rotation; (b) an array of detectors disposed in a detector plane, such array of detectors being arranged in a plurality of sets of such detectors, each one of such sets being disposed along a different region extending radially from a central region of the array, such central region being coincident with the point of intersection of the axis of rotation and the detector plane; (c) means for skewing the detector and focal planes; and, (d) means, coupled to the skewing means, for processing signals produced by a selected one of the plurality of sets of detectors, such selected one of the sets being disposed in one of the radially extending regions disposed along, or adjacent to, the line formed by the intersection of the skewed detector and focal planes to provide a signal representative of the deviation of the center of the circle from the axis of rotation.

With such arrangement, even with the detector plane skewed with respect to the focal plane, because the line formed by the intersection of the skewed focal and detector plane is common to both the focal plane and the detector plane (and hence is in focus), processing of the outputs from the detectors disposed in, or adjacent to, such line results in processing of data produced by a focused portion of the energy. Therefore, processing of signals from focused images is, in effect, accomplished without requiring gimballing of the plurality of detectors and its associated cooling system.

BRIEF DESCRIPTION OF THE DRAWINGS

The aforementioned and other features of the invention will become more apparent by reference to the following description taken together in connection with the accompanying drawings in which:

FIG. 7A showing such path traced by the focused spot, S, when a target is orientated along the axis of rotation, and FIG. 7B showing the path traced by such spot, S, when the target is orientated at an angle $\phi$ with respect to a reference axis of the missile's body and displaced in angle from the axis of rotation an amount proportional to $R_T$;

FIG. 9A is a frontal view showing the orientation of a cage coil located in the gimbal control section relative to the primary mirror housing and the pitch and yaw axis of the missiles, and FIG. 9B is a cross-section diagrammatical sketch taken along the missile body's yaw axis showing the orientation of the cage coil of FIG. 9A, and an adjacent precession coil used in the gimbal control section, relative to the housing of the primary mirror and the pitch and yaw axis of the missile;

FIG. 10A showing the time history of the voltage induced in one of the pair of reference coils; and FIGS. 10B–10D showing the time history of voltages induced in the cage coil after compensation for three correspondingly different skew angular orientations between the detector plane and the focal plane.

DESCRIPTION OF THE PREFERRED EMBODIMENT

Figure 1:
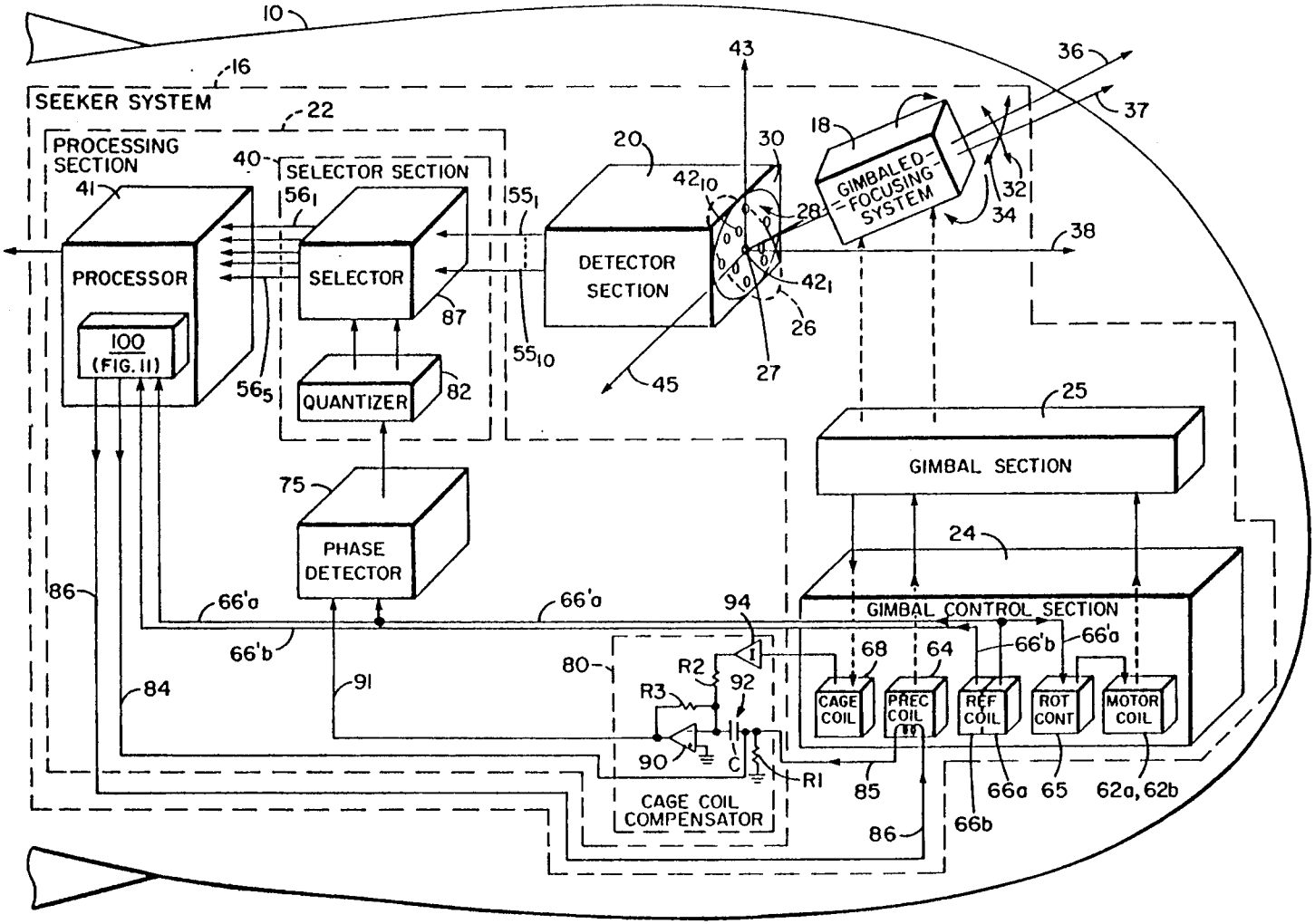
FIG. 1 is a simplified isometric sketch of the frontal portion of a missile incorporating an optical system according to the invention as the seeker thereof.
Figure 3:
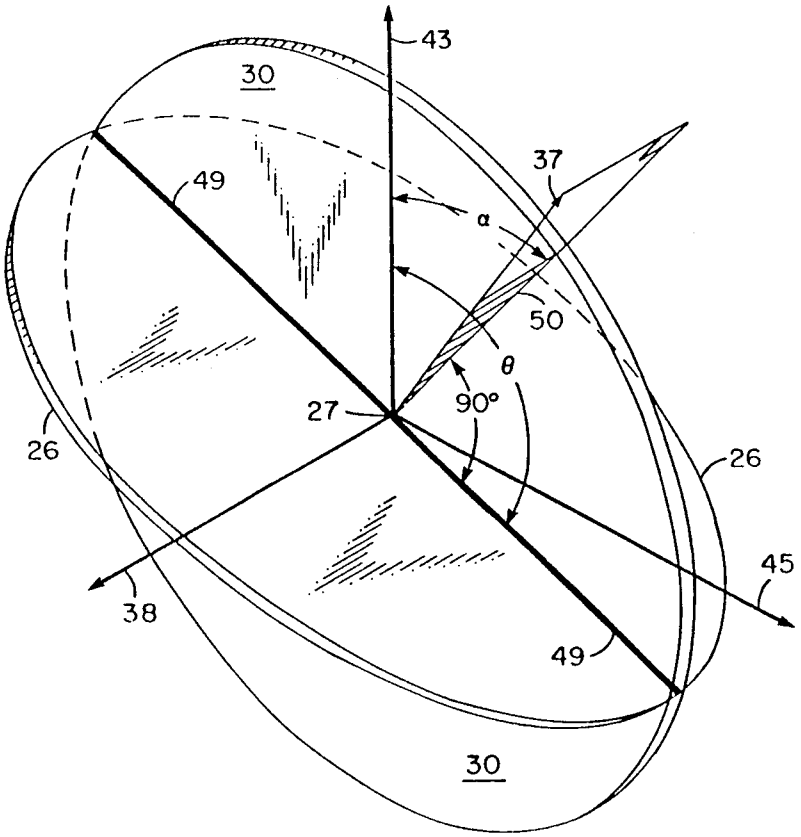
FIG. 3 is a sketch showing the focal plane of a gimballed scanning and focusing system used in the seeker of FIG. 1 and the detector plane of FIG. 2 having disposed therein an array of detectors used in such seeker when the planes are in a skewed condition.

Referring now to FIG. 1, a guided missile 10 is shown to carry within its frontal portion an optical system, here a missile seeker 16, such missile seeker 16 being responsive to that portion of the infrared energy radiated from an object, here a target (not shown) and entering the frontal portion of the missile 10. The seeker 16 includes a gimballed scanning and focusing system 18, a detector section 20, a processing section 22, a gimbal control section 24, and a gimbal section 25. The gimballed scanning and focusing system 18 focuses a portion of the radiant energy passing through the frontal portion of the missile 10 onto a spot in a focal plane 26 (shown in phanton in FIG. 1) and rotates about an axis of rotation 37 to scan such focused spot in a circular path on the focal plane 26. The detector section 20 includes a plurality of, here 10, detectors $42_1$–$42_{10}$ arranged in an array 28 disposed in a detector plane 30, as shown in detail in FIG. 2. The detector plane 30 is fixed to the body of missile 10. As will be described hereinafter, if the scanning and focusing system 18 is gimballed in pitch and/or yaw relative to the body of missile 10 (as indicated by arrows 32, 34) by magnetically coupled forces generated by the gimbal control section 24 and/or if the missile's body pitches and/or yaws and/or rolls in space, the focal plane 26 of the scanning and focusing system 18 may be skewed with respect to the detector plane 30, as shown in FIG. 3. Hence, when in a skewed condition, while one portion of the array 28 of detectors will be out of focus, the portion of the array 28 on, or adjacent to, the line 49 (FIG. 3) formed by the intersection of the skewed detector and focal planes 30, 26, will be in, or substantially in, focus. Referring again to FIG. 1, the processing section 22 includes a selector section 40 for identifying and, then coupling, the portion of the detectors $42_1$–$42_{10}$ of array 28 disposed in, or adjacent to line 49, and hence in, or substantially in, focus to processor 41. The processor 41, in response to the signals produced by the identified and coupled portion of the detectors $42_1$–$42_{10}$ produces, inter alia, a signal representative of the deviation of the line of sight to the target (hereinafter referred to as the boresight error axis 36 from the axis of rotation 37 (i.e., a signal representative of boresight error). This boresight error signal is used to guide the missile 10 toward the target and is also fed from processor 41 gimbal control section 24, via line 86, to move the scanning and focusing system 18 to maintain track of the target.

Figure 2:
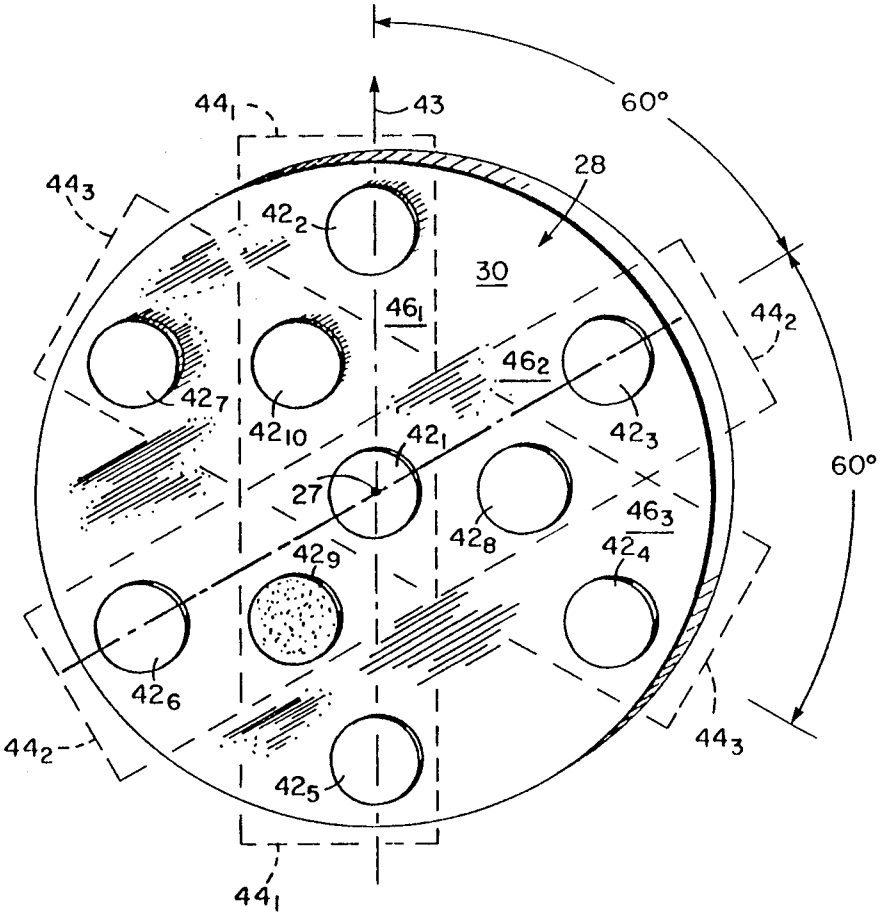
FIG. 2 is the diagram of the array of detectors used in the seeker of FIG. 1, such array being disposed in a detector plane.

The detector section 20, as mentioned above, includes a plurality of detectors, here 10 detectors $42_1$–$42_{10}$, arranged as shown in FIG. 2, in array 28 disposed in the detector plane 30. The detector plane 30 is fixed to the body of missile 10 and is normal to the longitudinal center line 38 of the missile 10. As shown, detector $42_1$ is positioned at the center 27 of the array 28. The center 27 is along the missile's center line 38. Detectors $42_2$, $42_3$, $42_4$, $42_5$, $42_6$ and $42_7$, are regularly angularly spaced along the outer, circumferential, periphery of the array 28 about the centrally positioned detector $42_1$. Detector $42_2$ is positioned along the missile body's yaw axis 43. Thus, detector $42_2$ is disposed at 0°, and detectors $42_3$, $42_4$, $42_5$, $42_6$ and $42_7$, are positioned at 60°, 120°, 180°, 240° and 300°, respectively, from the missile's yaw axis 43. Disposed along the circumference of a circle concentric with the outer circumferential periphery and having a radius intermediate the radius of the outer periphery are detectors $42_8$, $42_9$, and $42_{10}$ Detector $42_8$ is positioned between detector 423 and 424 and hence is positioned 90° from detector $42_2$ (i.e., along the missile's pitch axis 45). Likewise, detector $42_9$ is positioned 210° from detector $42_1$ and detector $42_{10}$ is positioned 330° from detector $42_2$ It is further noted that detectors $42_1$–$42_{10}$ are arranged in three sets $44_1$, $44_2$ and $44_3$ Detectors $42_2$, $42_{10}$, $42_1$, $42_9$ and $42_5$ are in set $44_1$. Detectors $42_4$, $42_8$, $42_1$, $42_9$ and $42_6$ are in set $42_2$. Likewise, detectors $42_3$, $42_8$, $42_1$, $42_{10}$ and $42_7$ are in set $44_3$. Each one of the three sets $44_1$–$44_3$ is disposed along a corresponding one of three different, partially overlaping regions $46_1$–$46_3$ extending radially from the center 27 of the array 28 along directions 0°, 60° and 120° from the missile's yaw axis 43, respectively. Thus, set $44_1$ is directed along the 0° (and 180°) or missile body's yaw axis 43. Set $44_2$ is directed along a line 60° (240°) from the missile body's yaw axis 43. Set $44_3$ is directed along a line 120° (and 300°) from the missile body's yaw axis 43.

The array 28 of detectors $42_1$–$42_{10}$ is mounted to a Dewar flask and a cryogenic chamber included within the detector section 20 (FIG. 1), and fixed to the body of missile 10, for enabling a suitable cryogenic substance to cool the array 28 of detectors $42_1$–$42_{10}$. The mechanical pivot point of the gimballed scanning and focusing system 18 is in the detector plane 30 at the intersection of the axis of rotation 37 and the missile's center line 38. Thus, the mechanical pivot point is at the center 27 of the array 28 of detectors $42_1$–$42_{10}$, (i.e., it is coincident with detector $42_1$). It should also be noted that the axis of rotation 37 intersects the detector plane 30 at the center 27, or pivot point, regardless of the pitch, yaw, or roll angular excursion of the scanning and focusing system 18 which excursion may be produced by the gimbal control section 24 acting on the gimbal section 25 and/or by the motion of the missile 10 in space, acting signals produced by processor 41, as noted above.

As further noted above, the scanning and focusing system 18 focuses infrared energy from the target passing through the frontal portion of the missile 10 onto the focal plane 26 (shown in phantom in FIG. 1). When the gimballed scanning and focusing system 18 is directed along the longitudinal center line 38 of the missile 10, the detector plane 30 is co-planar with the focal plane 26 and the image formed by the focusing system 18 will be in focus with all of the detectors $44_1$–$44_{10}$ in the array 28. However, as mentioned above, if the scanning and focusing system 18 moves in pitch and yaw relative to the missile's body by the gimbal control section 24 acting on gimbal section 25, as when tracking a target, and/or if the missile's body pitches and/or yaws and/or rolls in space, the focal plane 26 and the detector plane 30 will become skewed as shown in FIG. 2 and 4. Thus, in this skewed condition the image formed by the scanning and focusing system 18 will not be in focus with all of the detectors $44_1$–$44_{10}$ in the detector plane 30. It is noted however, that the image will be in focus along the line 49 (FIG. 3) formed by the intersection of the skewed focal and detector planes 26, 30. It is noted that the line 49 of intersection is the line, in the detector plane 30, which is perpendicular (i.e., 90°) to the projection 50 of the axis of rotation 37 onto the detector plane 30. The projection 50 of the axis of rotation 37 is shown at an angle $\alpha$ from the missile's yaw axis 43. Thus, the angular deviation, $\theta$, of the line 49 of intersection from a reference axis fixed to the body, such as the missile yaw axis 43 or pitch axis 45, here the yaw axis 43, is equal to $(\alpha+90°)$. As will be described, the angle $\alpha$ is quantized to a selected one of six values and is obtained from signals produced by gimbal control section 24 in a manner to be described. Suffice it to say here, however, that in response to the signals produced by gimbal control section 24 (FIG. 1) the processing section 22 enables selection of the one of the three sets $44_1$–$44_2$ of detectors (FIG. 2) disposed along, or adjacent to line 49, and hence in, or substantially in, focus by the gimballed scanning and focusing system 18. More specifically, an output, to be described, produced by the gimbal control section 24 is fed to the processing section 22. Processing section 22 includes a phase detector 75 which, in response to the signals produced by the gimbal control section 24 in a manner to be described, produces a signal representative of the quantized angular deviation $\alpha$. This signal is used as a control signal for the selector section 40 included within the processing section 22. The selector section 40 is fed by the outputs of the 10 detectors $42_1$–$42_{10}$ on lines $55_1$–$55_{10}$, respectively. In response to the control signal provided by the phase detector 75 the outputs of 5 of the 10 detectors $42_1$–$42_{10}$ in the selected one of the three sets $44_1$–$44_3$ of detectors which are well focused are selectively coupled to a processor 41 via lines $56_1$–$56_5$ while the remaining, unselected 5 detectors (i.e., the detectors in the unselected 2 sets $44_1$–$44_3$ of detectors) are inhibited from passing to the processor 41.

Figure 4A:
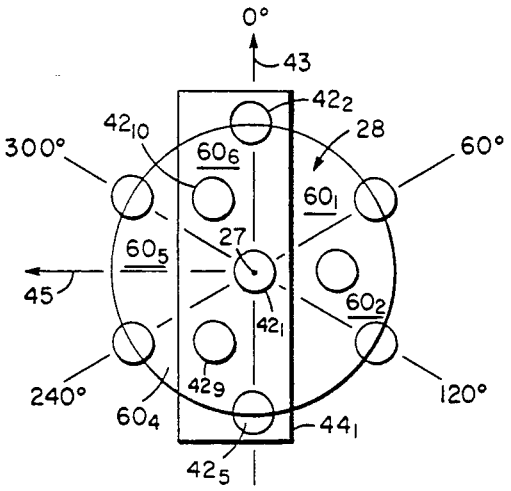
FIG. 4A–4C show the orientation of three sets of detectors in the array of FIG. 2 and the relationship of such sets to six sectoral regions of the detector array.
Figure 4B:
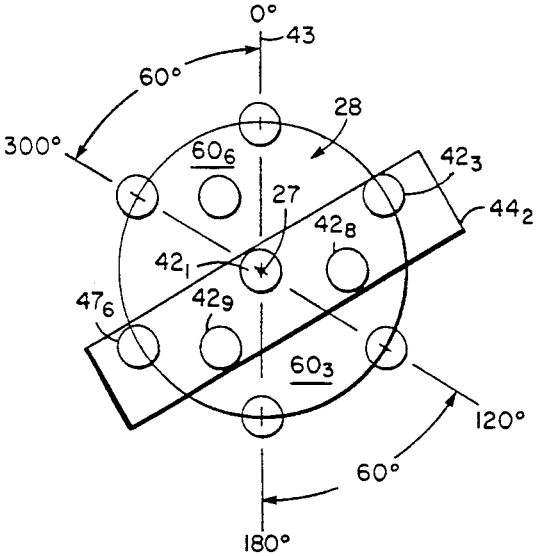
Figure 4C:
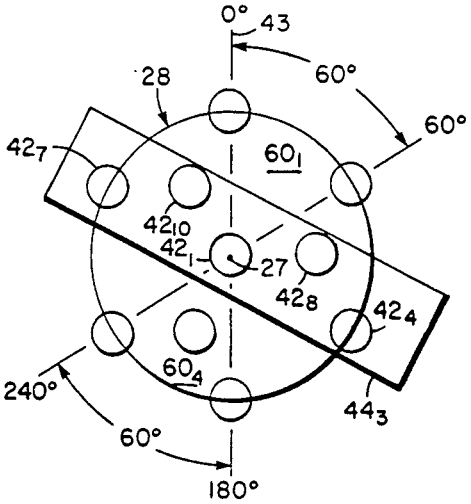

More specifically, as shown in FIG. 4A, the array 28 of detectors $42_1$–$42_{10}$ is quantized into a plurality of, here 6, equal angular sectors $60_1$ to $60_6$. Thus, the intersectors of the sectors $60_1$ to $60_6$ are disposed at angles 0°, 60°, 120°, 180°, 240° and 300°, respectively, from the missile body's yaw axis 43. Thus, as noted above, and as will be described, the gimbal control section 24 produces signals which enable determination of the quantized angular deviation, $\alpha$, of the projection 50 of the axis of rotation 37 (FIG. 3) onto the detector plane 30, from the missile body's yaw axis 43 to within one of the six sectors $60_1$–$60_6$ Further, as described above in connection with FIG. 3, the line 49 of intersection of the skewed focal and detector planes 26, 30, is at an angle $\theta=\alpha+90°$ from the missile's yaw axis 43. Thus, referring also to FIGS. 4A–4C, if the signals produced by the gimbal control section 24 indicates that $\alpha$ (which is perpendicular to the line 49 of intersection) is between 60° and 120° (i.e., in sector $60_2$), or between 240° and 300°, (i.e., in sector $60_5$), the detectors $42_2$, $42_{10}$, $42_1$, $42_9$ and $42_5$ in set $44_1$ are selectively coupled to the processor 41 by selector section 40. If $\alpha$ is between 0° and 60°, or between 180° and 240°, (FIG. 4C), the detectors $42_7$, $42_{10}$, $42_1$, $42_8$ and $42_4$, in set $44_3$ are selectively coupled to the processor 41. Likewise, if $\alpha$ is between 120° and 180°, or between 300° and 360°, (or 0°) (FIG. 4B) the detectors $42_3$, $42_8$, $42_1$, $42_9$ and $42_6$, in set $44_2$ are selectively coupled to the processor 41. This arrangement thus provides that five detectors from the total of 10, $42_1$–$42_{10}$ in the one of the three sets $44_1$–$44_3$ aligned along, or adjacent to line 49 (and hence, which are in, or are substantially in focus) pass to the processor 41. The energy impinging on the selected one of the three sets $44_1$–$44_3$ of detectors in the detector array 28 is processed by the processing section 22 (FIG. 1), to produce electrical signals for the wing control section (not shown) of the missile 10 and via line 86 for the gimbal control section 24. As will be described, the gimbal section 25, in response to gimbal section 24, is used to gimbal the scanning and focusing system 18 within the missile 10 so as to cause the optical system 16 to track the target independent of missile pitch, yaw or roll motion. More specifically to gimbal the scanning and focusing system 18 within the missile to drive the boresight error axis 36, here, preferably, towards the center of the array 28 of detectors $42_1$–$42_{10}$, i.e., towards detector $42_1$ Such arrangement prevents boresight error transients when switching between detector sets while tracking targets in pitch or yaw and when the missile rolls.

Figure 5:
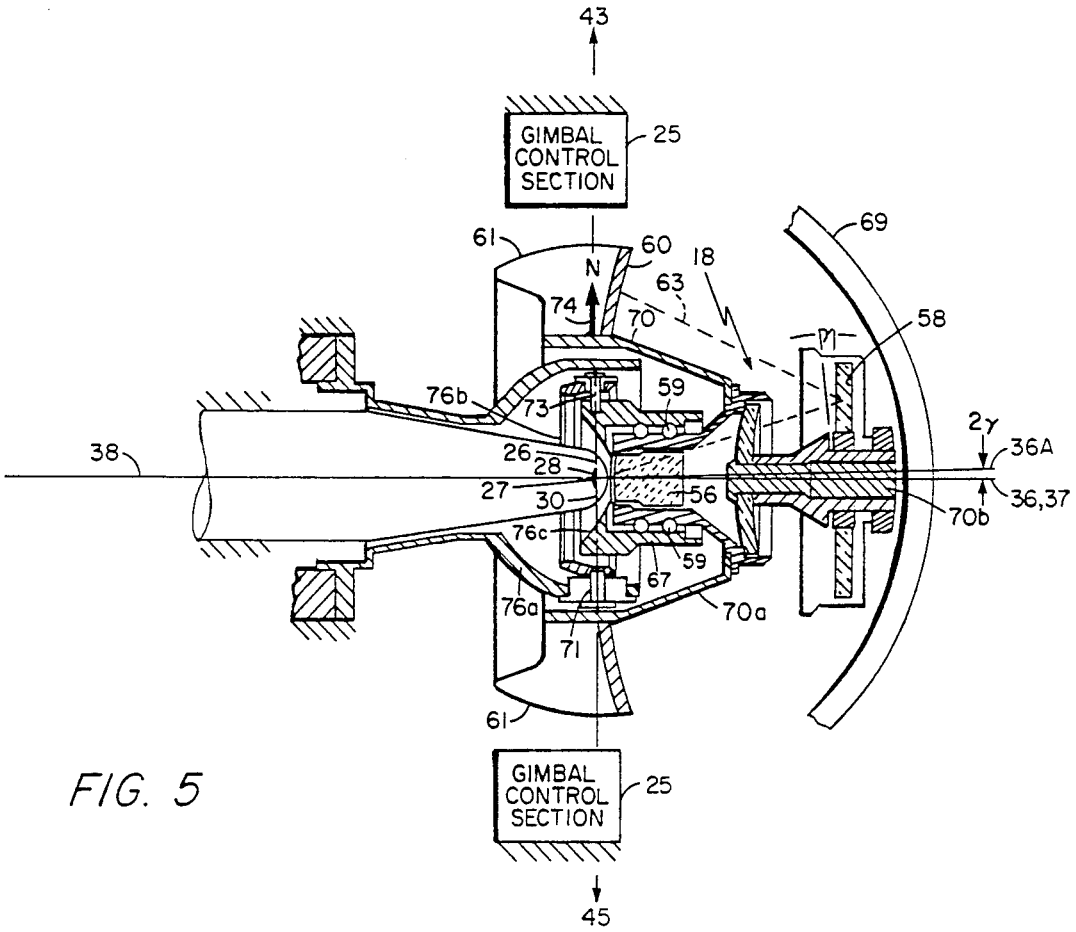
FIG. 5 is a cross-sectional sketch, greatly simplified, of the seeker of FIG. 1 with the gimballed axis of rotation of the optical system aligned with the longitudinal center line, of the missile, the upper half of such cross-section being taken along a yaw axis of the body of the missile and the bottom half being taken along the pitch axis of the missile.

Referring now to FIG. 5, the scanning and focusing system 18 is here shown with the boresight error axis 36 aligned with the axis of rotation 37 and the center line 38 of the missile. The upper half of FIG. 5 is a cross section taken along the missile body's yaw axis 43 and the cross section of the bottom half of FIG. 5 is taken along the missile body's pitch axis 45. The focusing system 18 includes a catadioptric optical arrangement which here includes a spherical primary mirror 60 and an attached flat secondary mirror 58, and attached focusing lens 56, here silicon, disposed symetrically about an axis of rotation 37. The flat secondary mirror 58, is disposed in a plane tilted at an angle $\gamma$ with respect to a plane normal to the axis of rotation 37. Thus, the optic axis is displaced from the axis of rotation 37 by 2 $\gamma$. More specifically, the plane of the tilted secondary mirror 58 intersects the focal plane 26 and at the angle $\gamma$. The flat secondary mirror 58, lens 56, and the primary mirror 60 are fixedly attached to one another by supports **70*a* and 70*b*. The catadioptric optical arrangement focuses a portion of the infrared energy from the target passing through the missile's frontal portion into a small spot on the focal plane 26. The frontal portion of the missile 10 is a conventional IR dome 69 rigidly mounted to the missile 10. The IR dome 69 is optically designed to reduce spherical aberration introduced by the spherical primary mirror 60. The flat secondary mirror 58 is used to fold and displace the path of infrared energy within the scanning and focusing system 18, as shown by the dotted line 63. The primary mirror 60 and attached tilted, flat, secondary mirror 58, and lens 56 (which has its instantaneous optic axis 36A displaced by the 2 $\gamma$ from the axis of rotation 37), are adapted to rotate, as one unit, with respect to the body of missile 10, about the axis of rotation 37 of the scanning and focusing system 18, here by forming the primary mirror 60 as the rotor of an electrical motor. In particular, the housing 61 of the primary mirror 60 is a permanent magnet having north and south poles, the north pole indicated by N (shown in FIG. 5) and is here aligned with the missile body's yaw axis 43. As will be described, a primary purpose of the rotating housing 61 is to form a gyroscope such that the primary mirror 60 will maintain the axis of rotation 37 in inertial space, uncoupled from the body of the missile unless acted on by the gimbal control section 24 in response to signals fed through from processor 41 via line 86. It should be noted that, because the housing 61 is attached to the tilted mirror 58, the north/south axis 74 of the housing 61 intersects the plane of the tilted mirror 58 at the angle $\gamma$ even as the housing rotates about the axis of rotation 37**.

Figure 6:
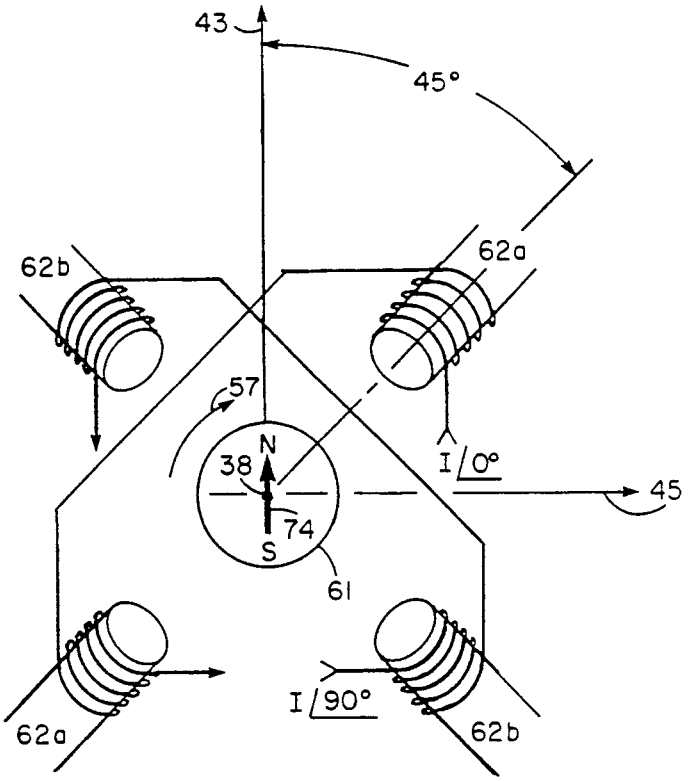
FIG. 6 is a diagrammatical sketch showing the relationship between motor coils used in a gimbal control section of the seeker of FIG. 1 to the pitch and yaw axis of the missile's body, and to a rotating permanent magnet housing for a primary mirror used in the optical system.

The housing 61 is adapted to rotate about the axis of rotation 37 by means of bearings 59 coupled between support structure **70*a* of the housing 61 and a hollow support member 67. The stator of such motor includes two pairs of motor coils 62*a*, 62*b* (FIG. 6) fixed to the body of the missile 10 in the gimbal control section 24. The motor coil pair 62*a* includes two serially connected coil sections, each wrapped around an axis 45° with respect to the missile body's yaw axis 43, as shown, on opposing sides of the permanent magnet housing 61. Likewise, motor coil pair 62*b* includes two serially connected coil sections, each wrapped around an axis −45° with respect to the missile body's yaw axis 43 on opposing sides of housing 61. A sinusoidal current, I, fed through motor coil pair 62*a* is 90° out of phase with the sinusoidal current, I, fed across motor coil pair 62*b*. The spatial orientation of the coil pair 62*a*, 62*b* and the phase of the currents applied to such coil pairs 62*a*, 62*b* establishes a magnetic field perpendicular to the missile's center line 38 which reacts with the magnetic field produced by permanent magnet housing 61, to produce a rotational torque about the axis of rotation 37. A pair of reference coils 66*a*, 66*b* (which will be described in detail hereinafter) is included in the gimbal control section 24 (FIG. 1). One of the pair of reference coil 66***a*, 66*b*, here reference coil 66*a*, produces a sinusoidal voltage on line 66'*a*; i.e., a reference signal indicating the rotational position of the north/south axis 74 relative to the body yaw axis 43 as well as the rotational rate ($\omega$) of the housing 61. This reference signal on line 66'*a* from reference coil 66*a* is fed, inter alia, to a rotation rate, or speed controller 65. The rotation speed controller 65 adjusts the sinusoidal current (both magnitude and phase) to the motor coil pairs 62*a*, 62*b* in response to the rotational rate signal produced by the reference coil 66*a* to cause a constant angular rate of rotation ($\omega$) of the primary mirror 60 about the axis of rotation 37, as indicated by arrows 57 in FIG. 6, in a conventional feedback system manner.

Referring again to FIG. 5, the hollow support member 67 (and hence the attached primary and secondary mirrors 60, 58, and lens 56) is mechanically coupled to the body of the missile 10 through a two-degree of freedom gimbal system made up of: a support 76*a*, fixed to the missile body; an outer gimbal ring 76*b*, pivotally coupled to the support 76*a* by a gimbal section bearing 71; and, an inner gimbal ring 76*c*, integrally formed with hollow support member 67 and pivotally coupled to outer gimbal ring 76*b* by bearing 73. The rotation axis of bearings 71, 73 are orthogonal to each other and both pass through pivot point 27, detector plane 30, and focal plane 26.

Figure 7A:
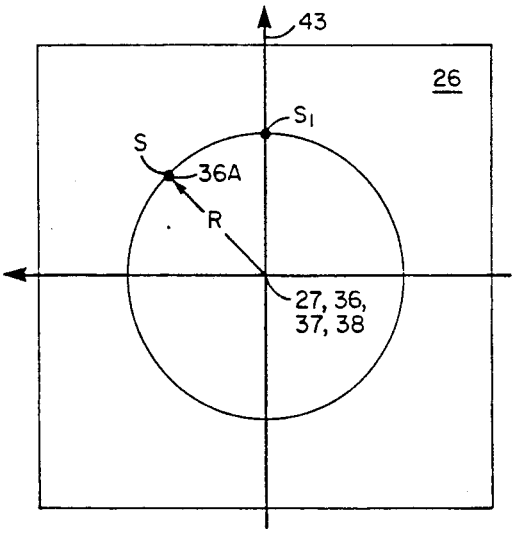
FIG. 7A–7B are sketches of the path traced by a focused spot, S, on a focal plane as a scanning and focusing system of the optical system rotates about an axis of rotation.
Figure 7B:
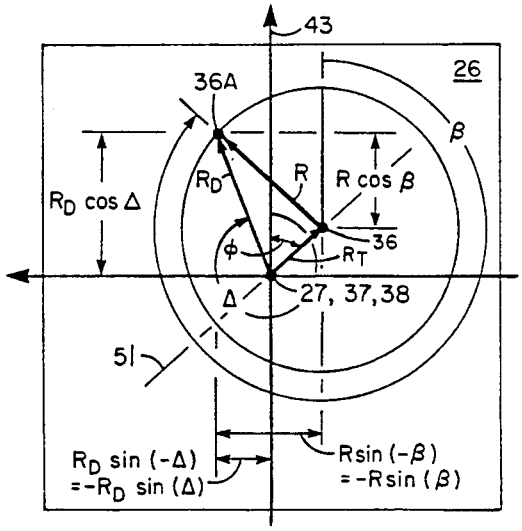

In operation, then, infrared energy from the target passing through the frontal portion of the missile 10 is scanned and focused to a small spot in the focal plane 26 by the catadioptric focusing arrangement. The secondary mirror 58 is tilted, as described, so that it nutates the spot along the instantaneous optic axis 36A about the axis of rotation 37 when tracking a target with no boresight error; i.e., the boresight error axis 36 is coincident with the axis of rotation 37. As the scanning and focusing system 18 rotates about the axis of rotation 37, the optic axis of the catadioptric arrangement will trace a circle in the focal plane 26. Thus, the spot, which is at the intersection of the focal plane 26 and the optic axis, will scan, or trace a circular path on the focal plane 26. The center of the circle formed by the instantaneous optic axis 36A during a rotation of lens 56, secondary mirror 58 and primary mirror 60 will be along the boresight error axis 36. The boresight error is thus a function of the position of the center, 36, of the circle relative to the point of intersection of the axis of rotation 37 and the focal plane 26. Thus, for example, if the target were orientated along the axis of rotation 37, the energy from such would be focused to a spot, S, along the instantaneous optic axis 36A on the focal plane 26, as shown in FIG. 7A, translated from the center 27 of focal plane 26 by an amount R related to the tilt angle, $\gamma$, of the secondary mirror 58. Further, if the axis of rotation 37 were aligned with the missile's center line 38 and if the north/south axis 74 of the housing 61 were aligned with the missile body's yaw axis 43, the spot would lie on the body's yaw axis 43 as shown in FIG. 7A at point $S_1$, at one instant in time and as the housing 61, and attached secondary mirror 58, rotate about the axis of rotation 37, the spot, S, would trace a circle of radius R centered at the axis of rotation 37. If, however, the boresight error axis 36 was angularly offset from the axis of rotation 37, the spot, S, would be displaced from the axis of rotation 37 here an amount $R_T$ and as the tilted mirror 58 rotates about the axis of rotation 37, the spot, S, would again trace a circle of radius R. However, as shown in FIG. 7B, the center of such circle would now lie along an axis 51 on the focal plane 26, displaced by the angular deviation $\phi$ of axis 51 from the missile body's yaw axis 43. The angular deviation $\phi$ combined with the displacement of the center of the circle from the axis of rotation 37, $R_T$, provide the polar coordinates of the boresight error tracking signal produced by the processor 41 on line 86 to enable tracking of the target. (The tilted mirror 58, in effect, may be viewed as causing each of the detectors $42_1$–$42_{10}$ to sense and trace an independent circular region of object space as focused by the primary mirror 60. The independent circle center locations are determined by the location of each of the detectors $42_1$–$42_{10}$. The combined coverage of the five circles from the selectd one of the sets $44_1$–$44_3$ determines the field of view over which a target may be tracked or a boresight error signal generated). As noted above, if the axis of rotation 37 and the missile's center line 38 were not aligned, the focal and detector planes 26, 30 would be skewed and would intersect at an acute angle. Therefore, the axis of rotation 37 deviates from the missile's center line 38. In this skewed condition, the spot traced in the detector plane 30 will not be a circle, but rather will be an ellipse. However, because the ellipse crosses the detectors selected at the same place as the circle, no error is introduced. As noted above, the processor 41 responds only to detectors disposed in, or substantially in, both the detector plane 30 and the focal plane 26, the computation of the translation $R_T$center of the circle traced in the focal plane 26 and the angular deviation $\phi$ of the axis 51 from the missile body's yaw axis 43 enables the processor 41 to produce a proper target tracking boresight error signal on line 86 to drive the gimballed scanning focusing system 18 via gimbal control section 24 and gimbal section 25 to maintain track of the target.

Figure 8:
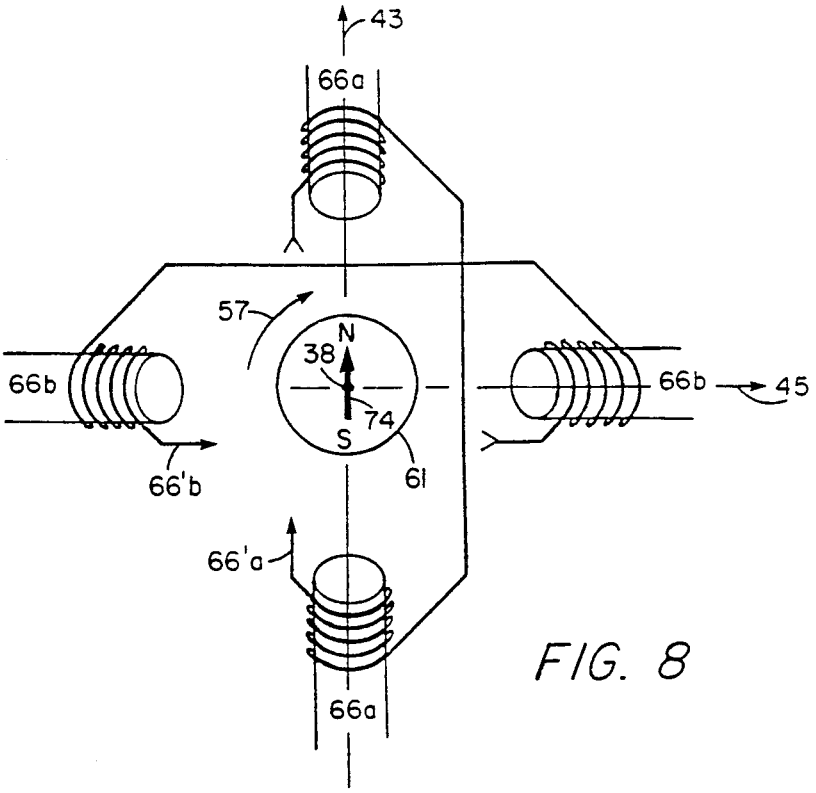
FIG. 8 is a diagrammatical sketch showing the relationship of a pair of reference coils used in the gimbal control section to the missile's body.

The pair of reference coils 66*a*, 66*b* are shown in FIG. 8, and sense the spin, or angular, orientation of the gimballed scanning and focusing system 18, relative to the missile's body. More particularly, the reference coil 66*a* is used to determine the rotational position of primary mirror housing 61 (more particularly the north/south axis 74), about the axis of rotation 37, relative to the yaw axis 43 and reference coil 66*b* is used similarly relative to the pitch axis 45. The reference coil 66*a* shown in FIG. 8 to be made up of two serially connected coil sections fixed to the body of missile 10 and wrapped around the missile's yaw axis 43 on opposite sides of permanent magnetic housing 61 and reference coil 66*b* is made up of two serially connected coil sections fixed to the body of the missile 10 and wrapped around the missile's pitch axis 45 on opposite sides of housing 61. As the permanent magnetic housing 61 of the primary mirror rotates about the axis of rotation 37, the magnetic field produced by such housing 61 rotates about the axis of rotation 37. A component of such magnetic field rotation occurs about the missile's center line 38. The accompanying time rate of change in magnetic field induces a sinusoidal voltage on line 66'*a* of the reference coil 66*a*. The phase of the induced sinusoidal voltage on line 66'*a* relates to the angular orientation of the housing 61 relative to the missile body's yaw axis 43. More particularly, the sinusoidal voltage induced in reference coil 66*a* reaches a maximum (or minimum) when the north/south axis 74 is perpendicular to the missile body's yaw axis 43. Likewise, the sinusoidal voltage induced in reference coil 66*b* reaches a maximum (or minimum) when the north/south axis is perpendicular to the missile body's pitch axis 45. Therefore, when the reference coil 66*a* induced voltage on line 66'*a* reaches a maximum, an indication is provided that the north/south axis 74 is perpendicular to the missile body's yaw axis 43. Likewise, when the reference coil 66*b* induced voltage on line 66'*b* reaches a maximum, an indication is provided that the north/south axis 74 is perpendicular to the missile's pitch axis 45. Thus, the induced voltage on line 66'*a* of reference coil 66*a* provides a reference signal which indicates the rotational angular orientation of the primary mirror 60 (and hence, the tilt of the tilted secondary mirror 58) relative to the missile body's yaw axis 43 and the induced voltage in line 66'*b* of reference coil 66*a* provides a reference signal which indicates the rotational angular orientation of the tilted secondary mirror 58 relative to pitch axis 45.

Figure 9A:
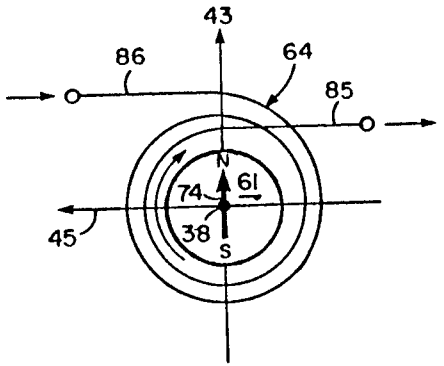
FIG. 9A and 9B are diagrammatical sketches.
Figure 9B:
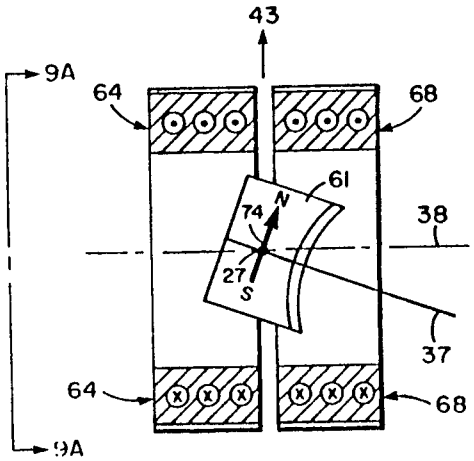

The gimbal control section 24 also includes a precession coil 64 (FIGS. 9A and 9B) for driving the gimballed scanning and focusing system 18 about the gimbal system bearing 73 and the orthogonal gimbal system bearing 71 (FIG. 5) indicated by arrows 32, 34 as mentioned above in connection with FIG. 1. More particularly, the precession coil 64 is fixed to the body of missile 10 and is wrapped circumferentially about the missile's center line 38. As shown in FIGS. 9A and 9B, the precession coil 64 encircles the housing 61 of the primary mirror 60. A sinusoidal precession coil current, having a period equal to the period of rotation of the housing 61 about the axis of rotation 37, is fed to the precession coil 64 from processor 41 (FIG. 1) via line 86 in a manner to be described. The precession coil current is produced to enable the gimballed scanning and focusing system 18 to maintain track of target (FIG. 1). More particularly, in response to the precession coil current a magnetic field component perpendicular to magnetic field 74 (produced by the housing 61 of the primary mirror 60) is produced by the precession coil 64 which reacts with the rotating magnetic field 74 produced by permanent magnetic housing 61 to produce a torque on the housing 61. In response to such torque the position of the axis of rotation 37, in inertial space, changes about pivot point 27. The magnitude of the rate of change in the angular position of the axis of rotation 37 in inertial space is proportional to the magnitude of the current passed to the precession coil 64 by processor 41 via line 86 and is proportional to the magnitude $R_T$ of the boresight error. The angular direction of such rate of change in angular position of the axis of rotation 37 in inertial space is related to the phase of the boresight error $\phi$ and proportional to the phase of the sinusoidal current in the precession coil 64. A precession coil current is generated on line 86 from the quadrature sinusoidal voltages induced in the pair of reference coils 66*a* and 66*b* which pair of voltages are algebraically added proportional to the boresight error in the yaw and pitch planes, respectively, in quadrature combining circuitry 100 within processor 41 (to be described hereinafter in detail in connection with FIG. 11). Suffice it to say here, however, that the resultant current produced by the quadrature combining circuit 100 is fed, via line 86, to the precession coil 64. Futher, the angular direction of the change in the axis of rotation 37 in inertial space is related to the phase between the sinusoidal current fed to precession coil 64 (via line 86) and the orientation of the magnetic housing 61 north/south magnetic field. The precession coil 64 current (on line 86) is, as will be discussed in detail in connection with the combining circuit 100 (FIG. 11), derived from the boresight error and the reference coils 66*a*, 66*b* voltages induced on lines 66'*a*, 66'*b* respectively. The magnitude of the boresight error controls the magnitude of the current fed to the precession coil 64 via line 86.

Finally, the gimbal control section system 24 includes a cage coil 68, shown in FIG. 9B, to sense the angular deviation of the axis of rotation 37 from the missile body's center line 38. Cage coil 68 is fixed to the body of missile 10 and is wrapped circumferentially about the missile body's center line 38 in a manner similar to precession coil 64 to encircle the permanent magnetic housing 61 of primary mirror 60. The cage coil 68 is disposed laterally along the missile body's center line 38 adjacent to the precession coil 64. As permanent magnet housing 61 rotates about the missile body's center line 38 a component of the associated rotating magnetic field produced by such housing 61 induces a sinusoidal voltage in the cage coil 68 with a magnitude related to the rate of change of the magnetic flux linking to the cage coil 68. The magnitude of the induced voltage is proportional to the magnitude of the angular deviation of the axis of rotation 37 from the missile's center line 38. The magnitude of the cage coil 68 voltage in phase with the induced voltage in the reference coil 66*a* on line 66'*a* is proportional to the magnitude of the angular deviation of the axis of rotation 37 from the missile's yaw axis 43 ( and similarly for the pitch axis 45 when using the reference coil 66*b*). When the gimballed scanning and focusing system 18 is driven to rotate about the axis of rotation 37 by the motor coils 62*a*, 62*b* the focusing system 18 acts like a two degree of freedom gyroscopic and unless driven to move in pitch and or/yaw relative to an inertial angle by activation using the precession coil 64, the gyroscopic effect of the spinning housing 61 will maintain the axis of rotation 37 pointed in a particular direction in inertial space regardless of pitch and/or yaw and/or roll motion of the body of the missile 10 in inertial space. While, the focal plane 26 and the detector plane 30 may become skewed because either the body of the missile 10 pitches and/or yaws and/or rolls in space, the precession coil 64 will drive the gimballed scanning and focusing system 18 in response to target angular motion only the angular rates need not be resolved into pitch and/or yaw rate relative to the body of the missile 10; or both for the control of the missile's trajectory since, as will be described in connection with FIG. 11, they are developed separately by the quadrature combining circuit 100 within processor 41 as pitch and yaw error signals.

Figures 10A, 10B, 10C, 10D:
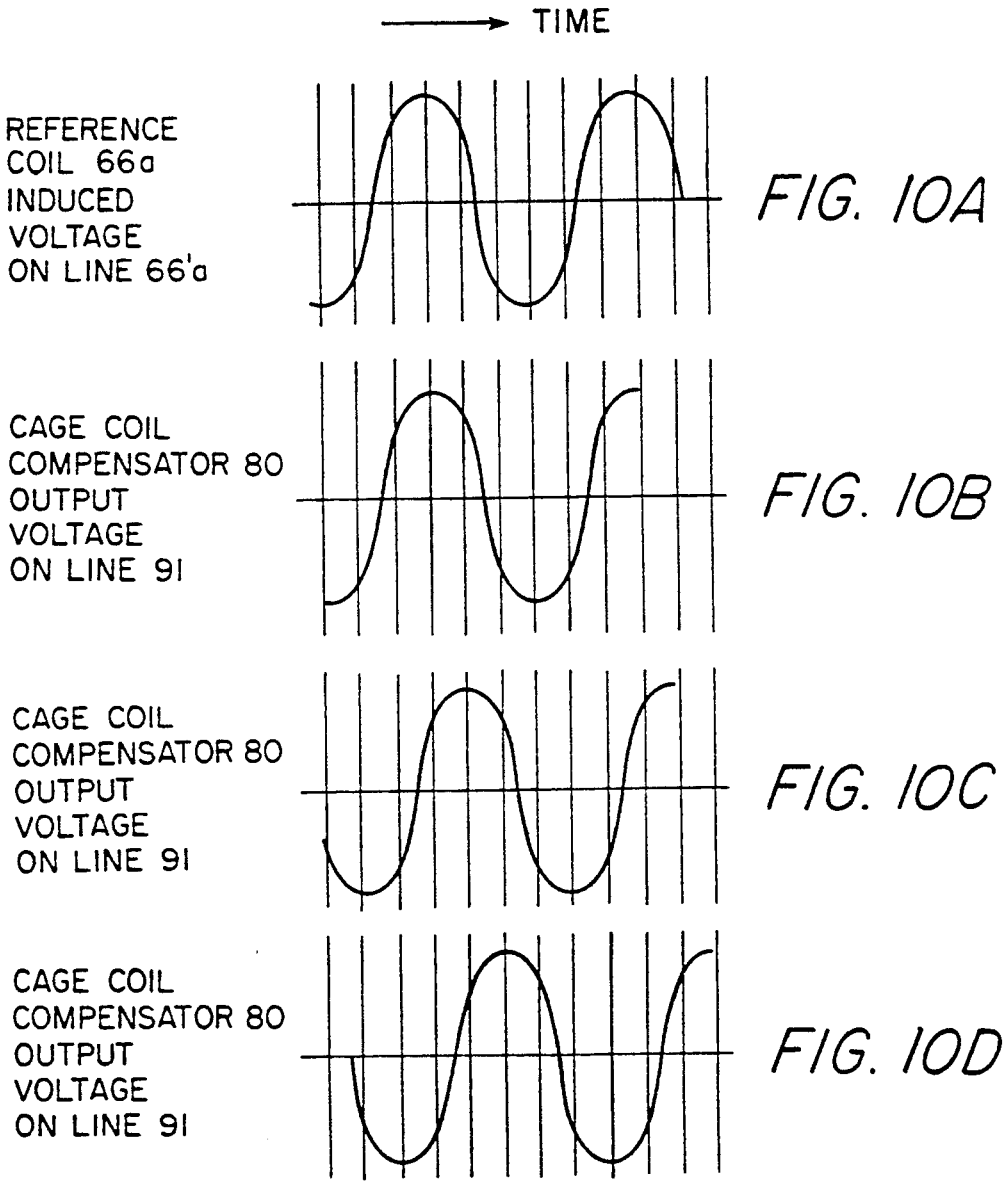
FIG. 10A–10D are time histories of voltages induced in one of the pair of reference coils and cage coil after compensation under different gimbal angle conditions.

As noted above, a sinusoidal voltage is induced in the reference coil 66*a* because the rotation of the permanent magnetic housing 61 produces a phase reference signal which provides an indication of the rotational orientation of the housing 61 relative to the missile's yaw axis 43. Further, as noted above, a sinusoidal voltage is induced in the cage coil 68 having a magnitude proportional to the angular deviation of the axis of rotation 37 from the missile center line 38, and a phase proportional to the difference between the axis of rotation 37 and yaw axis 43. The phase difference between the sinusoidal voltage developed by cage coil compensator 80 (in a manner to be described hereinafter) and the sinusoidal voltage induced in the reference coil 66*a* is equal to angular deviation $\alpha$ of the projection 50 (FIG. 3) of the axis of rotation 37 onto the detector plane 30 from the missile body's yaw axis 43. The time history of the voltage induced in the reference coil 66*a* after compensation by compensator 80 is shown in FIG. 10A. As noted also, the induced voltage reaches a maximum (positive or negative) amplitude when the north/south axis 74 of housing 61 passes through the missile body's pitch axis 45. The time history of the voltage induced in the cage coil 68 is shown in FIG. 10B after compensation for an angular deviation $\alpha$ (which is perpendicular to the line 49 of intersection of the detector and focal planes) from the missile body's yaw axis 43, which is between 0° and 60° (and 180° and 240°). FIG. 10C shows the time history of the voltage induced in the cage coil 68 after compensation as a function of time for an angular deviation $\alpha$ which is between 60° and 120° (and 240° and 300°). Likewise, FIG. 10D shows the time history of the voltage induced in the cage coil 68 as a function of time for an angular deviation $\alpha$ which is between 210° and 180° (30° and 360° )

A phase detector 75 (FIG. 1) is fed by the voltages induced in the reference coil 66*a* (on line 66'*a*) and the cage coil 68, after passing through a cage coil compensator 80, (to be described), to produce an output signal representative of the angular deviation $\alpha$ (which is perpendicular to the line 49 of intersection of the focal and detector planes). The output signal representative of $\alpha$ is fed to a quantizer 82. Quantizer 82 produces a 2-bit digital word representative of the 6 quantized angular sectors $\mathbf{60}_1$–$\mathbf{60}_6$ (FIG. 4A–4C) organized as three pairs and covered by arrays $\mathbf{44}_1$ and $\mathbf{44}_3$. Thus, if $\alpha$ is between 0° and 60°, (or between 180° and 240°) the 2-bit word is $(00)_2$; if $\alpha$ is between 60° and 120° (or between 240° and 300°), the 2-bit word is $(01)_2$; and if $\alpha$ is between 120° and 180° (or between 300° and 360°) the 2-bit word is $(11)_2$. The 2-bit word produced by quantizer 82 is fed as the control signal for selector 87. The outputs of detectors $\mathbf{42}_1$–$\mathbf{42}_{10}$ are fed to the selector 87 on line $\mathbf{55}_1$–$\mathbf{55}_{10}$, as noted above. In response to the 2-bit control word produced by quantizer 82, 5 of the 10 outputs of detectors $\mathbf{42}_1$–$\mathbf{42}_{10}$ are fed to processor 41, such 5 being, as discussed above, those in best focus and coupled to the detectors $\mathbf{42}_1$–$\mathbf{42}_{10}$ in one of the three sets $\mathbf{44}_1$–$\mathbf{44}_3$ in, or substantially in, focus by the scanning and focusing system 18. (That is, the set in, or adjacent to, the line 49 of intersection of the focal plane 26 and the skewed detector plane 30). Also fed to the processor 41 is the output voltage induced in the reference coil 66*a*. Thus, if the 2-bit word is $(00)_2$ only detectors $\mathbf{42}_2$, $\mathbf{42}_{10}$, $\mathbf{42}_1$, $\mathbf{42}_9$, $\mathbf{42}_5$ are identified and passed to processor 41. If the 2-bit word is $(01)_2$ only detectors $\mathbf{42}_3$, $\mathbf{42}_8$, $\mathbf{42}_1$, $\mathbf{42}_9$, $\mathbf{42}_6$ are identified and passed to processor 41. If the 2-bit word is $(10)_2$ only detectors $\mathbf{42}_4$, $\mathbf{42}_8$, $\mathbf{42}_1$, $\mathbf{42}_{10}$, $\mathbf{42}_7$ are identified and passed to processor 41.

Figure 11:
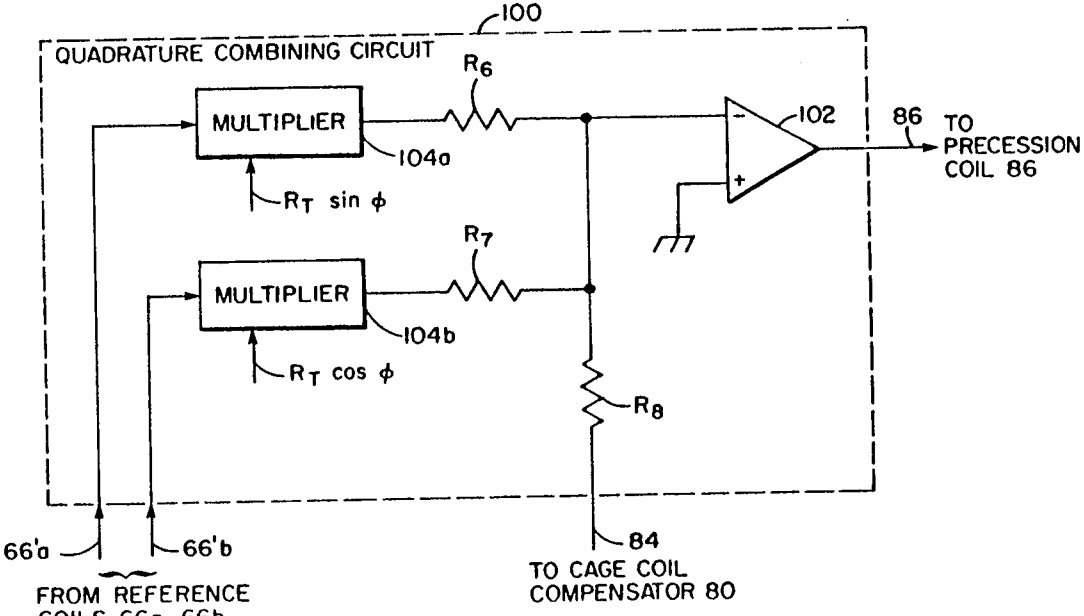
FIG. 11 is a block diagram of a quadrature combining circuit within the processor for combining voltages induced in the pair of reference coils to develop the current required for the precession coil for target tracking.

The processor 41 produces a sinusoidal current on line 86 which is fed to the precession coil 64 as will be described in detail hereinafter in connection with FIG. 11. Suffice it to say here however that the magnitude of the current on line 86 is proportional to the desired rate change in inertial space, of the axis of rotation 37. The phase of such current, relative to the sinusoidal reference coils 66*a*, 66*b* induced voltages, is proportional to the angular direction of such rate relative to the yaw axis 43 and the pitch axis 45. The phase and magnitude of the sinusoidal output current on line 86, are fed to the precession coil 64 to drive the scanning focusing system 18 so that the boresight error axis 36 is driven towards the central detector $\mathbf{42}_1$ as it maintains track of the target.

More particularly, the five detectors in the one of the three sets $\mathbf{44}_1$–$\mathbf{44}_3$ thereof in, or substantially in focus are fed to processor 41 through selector section 40. Also fed to processor 41 are the voltages induced in reference coils 66*a*, 66*b* (on lines 66'*a*, 66'*b*). Thus assume, as described above in connection with in FIG. 7B, the spot, S, in the focal plane 26 traces the circle shown in FIG. 7B, having a center along axis 51, (such axis 51 being at an angle $\phi$ with respect to the missile body yaw axis 43) and translated from the axis of rotation 37 an amount equal to $R_T$. The processor 41, in response to the outputs of the five detectors in focus with the focal plane 26 (and hence in common with the detector plane 30) and identified and fed thereto via selector 87, determines the amount of translation $R_T$ of the center of the circle from axis of rotation 37 and the angle $\phi$ to produce a signal representative of $R_T$ and $\phi$. For example, let it be assumed, as discussed above in connection with FIG. 7B, that the set $\mathbf{44}_3$ of detectors is in focus and that the detectors in such set 3 (and hence in focus) indicate that the circle traces through detector $\mathbf{42}_7$. The position of the center 27 of the detector plane 30 (i.e., the center detector $\mathbf{42}_1$ and the axis of rotation 37) relative to the positions of each of the detectors $\mathbf{42}_1$–$\mathbf{42}_{10}$ are known, a priori. These relative positions (both magnitude $R_D$ and angle $\Delta$ (relative to the yaw axis 43)) are stored in a read only memory (ROM), not shown, included in processor 41. Thus, detector $\mathbf{42}_7$ is at a known distance $R_{D7}$ from the center detector $\mathbf{42}_1$ (and the axis of rotation 37) and a known angle $\Delta_7$, as shown in FIG. 7B (here $\Delta_7 = 300° = -60°$). If the spot, S, traces a circular arc $\beta$ between the time the tilted mirror 58 places the optic axis through yaw axis 43 and the time of detection of such spot by detector $\mathbf{42}_7$ (i.e., a difference in time $\Delta T$) then, in the general case, the magnitude of the boresight error $R_T$ is:

$$R_T = \sqrt{(R_D \cos \Delta - R \cos \beta)^2 + (R_D \sin \Delta - R \sin \beta)^2} \quad \text{eq. (1)}$$

and the angle $\phi$ of such boresight error is:

$$\phi = \tan^{-1}\{[R_D \cos \Delta - R \cos \beta]/[R_D \sin \Delta - R \sin \beta]\} \quad \text{eq. (2)}$$

The angle $\beta$ is determined by a timer (not shown) included in processor 41. The timer is initiated by a signal produced from the reference coil 66*a* induced voltage and is stopped when there is an indication that one of the five detectors fed to processor 41 by selector 87 (i.e., the signal on one of the lines $\mathbf{56}_1$–$\mathbf{56}_5$) has detected the circularly travelling spot S. The contents of the counter contains the time $\Delta T$. Since the rotational rate of the secondary mirror 58 about the axis of rotation 37 is controlled to w as described above, $\beta = \omega(\Delta T)$ may be determined by the processor 41. A quadrature combining circuit 100 shown in FIG. 11 is included in processor 41. The voltages induced in reference coils 66*a*, 66*b*, are fed via lines 66'*a*, 66'*b*, respectively, to a summing amplifier 102 through multipliers 104*a*, 104*b*, and resistors $R_6$, $R_7$, respectively, as shown. Multiplier 104*a* is also fed by a signal produced within processor 41 by conventional microprocessor (not shown) from eq (1) and (2) equal to $R_T \sin \phi$. Likewise, multiplier 104*b* is also fed by a signal produced by the microprocessor (not shown) from eq (1) and (2) equal to $R_T \cos \phi$. The products produced by multiplier 104*a*, 104*b*, are summed by resistors $R_6$, $R_7$, at the (−) input of amplifier 102. The (−) input of amplifier 102 is also coupled to the precession coil 64 through resistor $R_8$ via lines 84, 85 for boresight error gain control. The (+) input of amplifier 102 is coupled to ground. The amplifier 102 combines the summed voltages into a total, resulting current which is fed to the precession coil 64 via line 86 which causes the scanning and focusing system 18 to track a target simultaneously in both pitch and yaw using a combined control signal. The resulting sinusoidal current produced on line 86 (FIG. 1) has a magnitude proportional to $R_T$ and the desired rate of change in inertial space of the axis of rotation 37, and a phase proportional to the angular direction $\phi$ of such rate from the missile body's yaw axis 43. As noted above, the signal on line 86 is used to drive the scanning and focusing system 18 to track the target and here, preferably, to drive the axis of rotation 37 towards the target and maintain the center of the spot's path centered on center detector $42_1$.

It is noted that in changing the magnitude of the sinusoidal current fed to the precession coil 64 a sinusoidal voltage is induced in the adjacent cage coil 68 (FIG. 9B). This cage coil 68 induced voltage is proportional to the rate of change in the precession coil 64 current (here a sinusoidal voltage in cage coil 68 induced by a sinusoidal current fed to precession coil 64. Further, as noted above, a sinusoidal voltage is also induced in the cage coil 68 proportional to the angular deviation of axis of rotation 37 from the missile's body center line 38. The cage coil 68 thus has induced in it a desired sinusoidal voltage (the voltage indicating the angular deviations of the axis of rotation 37 and from the missile body's center line 38) and an undesired sinusoidal voltage (the voltage induced in it in response to a sinusoidal current fed to the adjacent precession coil 64). To compensate for this undesired induced voltage in the cage coil 68, the cage coil compensator 80, as shown in FIG. 1, is provided. The cage coil compensator 80 is a differentiating and subtraction network and includes a differential amplifier 90 and an inverting buffer amplifier 94. The non-inverting (+) input of the differential amplifier 90 is connected to ground. The inverting (−) input of amplifier 90 is coupled to capacitor C, and resistor $R_2$. Resistor $R_3$ completes the circuit and adjusts gain through feedback. The precession coil current from the processor 41 fed via line 86 is returned via line 85 and develops a voltage across resistor $R_1$. The developed sinusoidal voltage is differentiated by the capacitor C which inputs to amplifier 90 a current equal to the derivative (i.e., time rate of change) of the developed sinusoidal voltage fed thereto on line 85, as shown in FIG. 1. Thus, current is fed to one end of the precession coil 64 by processor 41 via line 86; and the other end (i.e., line 85) of precession coil 64 is connected to ground through resistor $R_1$ and to the inverting (−) input of the amplifier 90 through the capacitor C. The output of the cage coil 68 is coupled, through the inverter buffer amplifier 94, and the second resistor $R_2$, to the inverting (−) input of amplifier 90, as shown. A third resistor $R_3$ provides a feedback resistor between the output and the inverting (−) input of the amplifier 90, as shown, to produce an output voltage proportional to the difference between the differentiated voltage and the induced voltage. Thus, resistor $R_1$ produces a voltage proportional to the current fed to the precession coil 64. The capacitor C produces a current proportional to the time rate of change in the current fed to precession coil 64 without adding any unwanted phase shift over a wide band of frequencies. As noted above, this change in the current fed to precession coil 64 induces an undesired voltage in the adjacent cage coil 68. The undesired portion of the voltage induced in cage coil 68 (that induced by the time rate of change in current fed to the precession coil 64) is subtracted from the total voltage induced in cage coil 68. In particular, a current proportional to the undesired portion of the cage coil 68 voltage is produced at the output of capacitor C and is subtracted from the current in resistor $R_2$ proportional to the total induced voltage in the cage coil 68 by the inverting buffer amplifier 94 so that the output of amplifier 90 (on line 91) represents the desired voltage induced in cage coil 68 (i.e., the voltage attributed to the position of the permanent magnet 61, FIG. 8B, from missile's center line 38). That is, the magnitude of the voltage produced by amplifier 90 is equal to the voltage induced in the cage coil 68 because of the magnitude of the angular deviation of the axis of rotation 37 relative to the missile's center line 38 and also, has a phase angle, relative to the voltage induced in the reference coil 66*a*, which, when phase detected, provides and angle $\alpha$.

Finally, it should be noted that each one of the detectors $42_1$–$42_{10}$ covers a different portion of the field of view of the seeker system 16. The field of view is proportional to the sum of twice the scan circle radius R and the distance between any two opposite detectors, twice $R_D$ in each set $44_1$, $44_2$, $44_3$.

Having described a preferred embodiment of the invention, other embodiments incorporating these concepts will now become evident to one of skill in the art. For example, the number of detectors may be different from the 10 detectors described herein. Therefore, it is felt that the invention should not be restricted to its disclosed embodiment but rather, should limited only by the spirit and scope of the appended claims.

What is claimed is:

1. An optical system comprising:

means for directing a portion of electromagnetic energy onto a focal plane;

an array of detectors disposed to provide a detector plane; and means for skewing the focal plane relative to the detector plane with one portion of the array of detectors being disposed in, or adjacent to, a line formed by the intersection of the detector plane and the skewed focal plane.

2. The optical system of claim 1 wherein said means for directing comprises a catadioptric arrangement comprising a spherical primary mirror and an attached flat secondary mirror, such primary and secondary mirror being symmetrically disposed about an axis of rotation.

3. The optical system of claim 2 with said array of detectors being arranged in a plurality of sets of such detectors, each one of such sets being disposed along a different region extending radially from a central region of the array, such central region being coincident with the point of intersection of the line formed by the intersection of the detector plane and the skewed focal plane.

4. A method for focusing an optical system comprising the steps of:

directing a portion of electromagnetic energy onto a focal plane; and skewing the focal plane relative to a detector plane said detector plane disposed in a portion of said focal plane and provided from a plurality of detectors, said plurality of detectors being arranged in a plurality of sets of such detectors, each one of such sets being disposed along a different radially extending region form a central region of the plurality of detectors.

5. The method of claim 4 further comprising the step of rotating the portion of electromagnetic energy about an axis of rotation.

6. The method of claim 5 further comprising the step of selectively coupling a portion of the focused electromagnetic energy to the set of detectors disposed in one of the radially extending regions disposed in or adjacent to the intersection of the detector plane and the skewed focal plane.

7. The method of claim 6 further comprising the step of processing signals produced by the set of detectors being disposed in or adjacent to one of the radially extending regions disposed along the intersection of the skewed detector and focal planes.

8. A method of for focusing an optical system comprising the steps of:

directing a portion of electromagnetic energy onto a focal plane; and providing relative angular rotation between the focal plane and a detector plane provided from an array of detectors with one portion of the array of detectors being disposed in or adjacent to the focal plane, and another portion of the array of detectors being spatially displaced from the focal plane.

9. The method of claim 8 wherein the step of directing a portion of electromagnetic energy includes the step of focusing a portion of the infrared energy from a target onto a spot on the focal plane, such spot being disposed along an optic axis of the focusing system, such focusing system including a catadioptric arrangement comprising a spherical primary mirror and an attached flat secondary mirror, such primary and secondary mirrors being symmetrically disposed about an axis of rotation, such secondary mirror being tilted by a predetermined angle with respect to an axis of rotation.

10. The method of claim 9 wherein the step of providing relative angular rotation includes the steps of:

rotating the catadioptric arrangement about the axis of rotation with the optic axis tracing a circle as it intersects the focal plane, the center of the circle having a deviation from the axis of rotation related to the angular deviation of the target from the axis of rotation; and skewing a focal plane relative to a detector plane, said detector plane provided from an array of detectors, such array of detectors being arranged in a plurality of sets of such detectors, each one of such sets being disposed along a different region extending radially from a central region of the array, such central region being coincident with the point of intersection of the axis rotation and the detector plane.

11. The method of claim 10 further comprising the steps of:

coupling signals provided by the array of detectors to a selector means; and coupling to an output of the selector means those signals provided by the set of detectors disposed in one of the radially extending regions disposed along or adjacent to a line formed by the intersection of the skewed detector and focal planes to provide a signal representative of the deviation of the center of the circle from the axis of rotation.

* * * * *